US008407942B1

(12) United States Patent
Jones

(10) Patent No.: US 8,407,942 B1
(45) Date of Patent: Apr. 2, 2013

(54) METHOD AND APPARATUS FOR REINFORCING DOOR JAMBS

(75) Inventor: Frederick Jones, Lithonia, GA (US)

(73) Assignee: Frederick L. Jones, Ellenwood, GA (US)

( * ) Notice: Subject to any disclaimer, the term of this patent is extended or adjusted under 35 U.S.C. 154(b) by 0 days.

(21) Appl. No.: 13/247,809

(22) Filed: Sep. 28, 2011

(51) Int. Cl.
*E05B 15/02* (2006.01)

(52) U.S. Cl. ..... 49/460; 292/346

(58) Field of Classification Search ..... 49/460; 292/340, 346
See application file for complete search history.

(56) References Cited

U.S. PATENT DOCUMENTS

| | | | | | |
|---|---|---|---|---|---|
| 1,672,962 | A | * | 6/1928 | Stratmann | 70/450 |
| 1,853,456 | A | * | 4/1932 | Ross | 292/346 |
| 3,815,945 | A | * | 6/1974 | Lamphere | 292/340 |
| 4,074,484 | A | * | 2/1978 | Queren | 52/214 |
| 4,345,787 | A | * | 8/1982 | Dabrowski | 292/346 |
| 4,383,709 | A | * | 5/1983 | Ronan | 292/346 |
| 4,690,445 | A | * | 9/1987 | Hartley | 292/341 |
| 4,712,816 | A | * | 12/1987 | Mueller | 292/253 |
| 4,717,185 | A | * | 1/1988 | Hartley | 292/340 |
| 4,720,129 | A | * | 1/1988 | Bouchard | 292/346 |
| 4,751,834 | A | * | 6/1988 | Beck | 70/452 |
| D302,937 | S | * | 8/1989 | Briggs | D8/344 |
| 4,854,621 | A | * | 8/1989 | Baldwin | 292/340 |
| 5,074,606 | A | * | 12/1991 | Priola et al. | 292/346 |
| 5,088,780 | A | * | 2/1992 | Doherty | 292/346 |
| 5,127,690 | A | * | 7/1992 | Kim et al. | 292/340 |
| 5,456,507 | A | * | 10/1995 | Jones | 292/340 |
| 5,566,509 | A | | 10/1996 | Long | |
| 5,566,995 | A | * | 10/1996 | Jagiela | 292/346 |
| 5,570,917 | A | * | 11/1996 | Cutrer | 292/346 |
| 5,581,948 | A | * | 12/1996 | Simonsen | 49/460 |
| 5,836,628 | A | | 11/1998 | Beier | |
| 5,934,024 | A | * | 8/1999 | Simpson | 49/462 |
| 6,406,076 | B1 | * | 6/2002 | Zarzycki, Jr. | 292/346 |
| 6,557,914 | B2 | * | 5/2003 | Hamilton et al. | 292/340 |
| 6,834,897 | B1 | * | 12/2004 | Walker | 292/340 |
| 6,857,672 | B1 | * | 2/2005 | Drew, II | 292/341.18 |
| 7,147,213 | B1 | * | 12/2006 | Amendola | 256/73 |
| 7,165,793 | B2 | * | 1/2007 | Richmond et al. | 292/346 |
| 7,360,809 | B1 | | 4/2008 | Poston | |
| D589,174 | S | * | 3/2009 | Drew, II | D25/199 |
| 2003/0062731 | A1 | * | 4/2003 | Richmond et al. | 292/346 |
| 2008/0224486 | A1 | | 9/2008 | Anderson | |
| 2012/0181801 | A1 | * | 7/2012 | Willis et al. | 292/338 |

* cited by examiner

*Primary Examiner* — Katherine Mitchell
*Assistant Examiner* — Justin Rephann

(57) ABSTRACT

A door jamb reinforcing device includes a first face member configured to engage with a face of a stop rail of the door jamb and a second face member interconnected with the first face member and configured to engage with a face of a latch-engagement portion of the door jamb. A first side member may be attached orthogonally to the first face member. A second side member may be attached orthogonally to the second face member. The first and second side members may be spaced apart from one another by a distance that corresponds to a width of the jamb.

7 Claims, 3 Drawing Sheets

METHOD AND APPARATUS FOR REINFORCING DOOR JAMBS

BACKGROUND OF THE INVENTION

The present invention generally relates to a system for reinforcing a door jamb. More particularly, the invention relates to a system in which a reinforcing device may be retrofitted onto a previously installed door assembly.

Entrance doors for buildings are often supported on wooden jambs. Typically, a latching device of a lock assembly may engage with a mortised opening in one of the jambs. A small metallic latching plate may be attached to the jamb and may surround the mortised opening. In such an assembly, the door may be held in a closed position with only structural strength of the wooden jamb resisting intrusion forces. A determined intruder may open such a door by applying force that overcomes the structural strength of the wooden jamb. For example, an intruder may kick the door to open it.

As can be seen, there is a need for a method of enhancing the structural strength of a latching system of a wooden-jamb door assembly. More particularly, there is a need for such a reinforcing device that can be easily installed onto a door assembly that is already in place within an opening of a building.

SUMMARY OF THE INVENTION

In one aspect of the present invention, a door jamb reinforcing device may comprise: a first face member configured to engage with a face of a stop rail of the door jamb; a second face member interconnected with the first face member and configured to engage with a face of a latch-engagement portion of the door jamb; a first side member attached orthogonally to the first face member; a second side member attached orthogonally to the second face member, the first and second side members being spaced apart from one another by a distance that corresponds to a width of the jamb.

In another aspect of the present invention, a method for reinforcing a door jamb may comprise the steps of: attaching a first metallic face member of an integral sheet metal reinforcing device to a face of a stop rail of the jamb; attaching a second face member of the device to a face of a latching portion of the jamb; attaching a first side member of the device to a side of the stop rail; and attaching a second side member of the device to a side of the latching portion of the jamb.

These and other features, aspects and advantages of the present invention will become better understood with reference to the following drawings, description and claims.

DETAILED DESCRIPTION OF THE INVENTION

Figure 1:
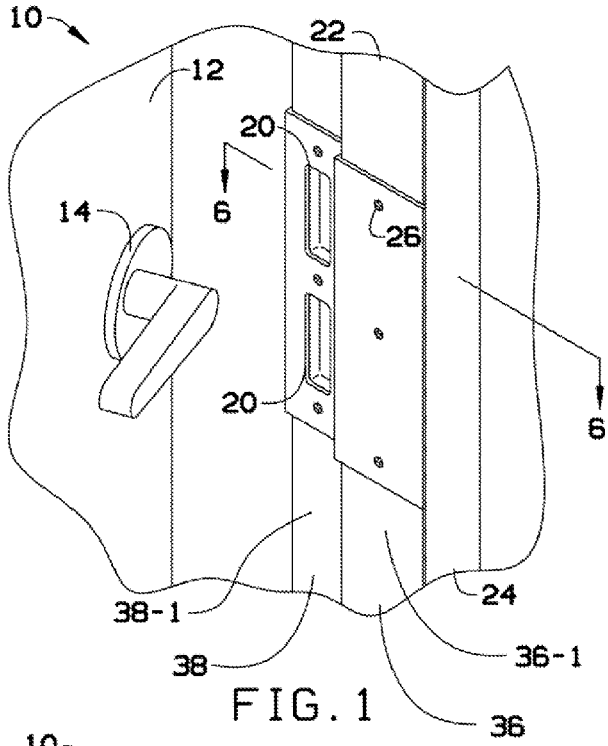
FIG. 1 is a perspective view of a reinforcing device installed in a door jamb in accordance with an embodiment of the invention.
Figure 2:
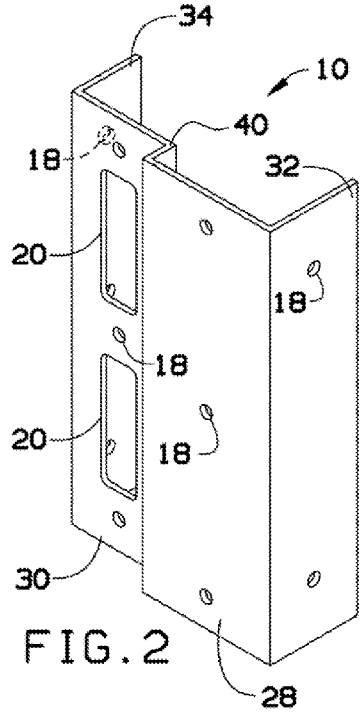
FIG. 2 is a perspective view of the reinforcing device of FIG. 1.
Figure 3:
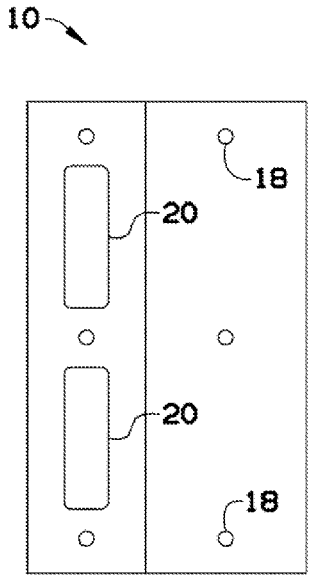
FIG. 3 is an elevation view of the reinforcing device of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a metallic reinforcing device to surround a latch-engagement portion of a wooden jamb of a previously installed door assembly Referring now to FIGS. 1-3 and 5-6, it may be seen that an exemplary embodiment of a reinforcing device 10 may comprise a first face member 28, a second face member 30, a first side member 32 and a second side member 34.

The face member 28 may be configured to engage with a face 36-1 of a stop rail 36 of a door jamb 22. The face member 30 may be configured to engage with a face 38-1 of a latch-engagement portion 38 of the door jamb 22. The side members 32 may be formed to lie in a plane that is orthogonal to a plane of the face member 28. The side member 34 may be formed to lie in a plane that is orthogonal to a plane of the face member 30. The side members 32 and 34 may be spaced apart from one another so that the side member 32 may engage with a side 36-2 of the stop rail 36 and so that the side member 34 may engage with a side 38-2 of the latch-engagement portion 38 of the jamb 22. In other words, the first and second side members may be spaced apart from one another by a distance that corresponds to a width of the jamb 22. A transition member 40 may be configured to interconnect the face members 28 and 30 and may lie in a plane that is orthogonal to the plane of the face members 28 and 30. The reinforcing device 10 may be provided with one or more latch openings 20 and holes 18 for screws 26.

Unlike prior art reinforcing devices, the reinforcing device 10 may be readily installed onto a previously installed door assembly. Installation may be performed by first removing molding 24 from the door assembly and placing the device 10 in position so that the latch openings 20 align with mortised latch openings of the jamb 22. Screws 26 may be installed to secure the device in position. The molding 24 may then be re-installed to cover the side members 32 and 34 of the device 10.

It may be seen that, when installed on the door jamb 22, the device 10 may provide an integral sheet metal reinforcement structure that may transfer potential intrusion force across a substantial length of the faces 36-1 and 38-1 as well as the sides 36-2 and 38-2 of the door jamb 22.

Figure 4:
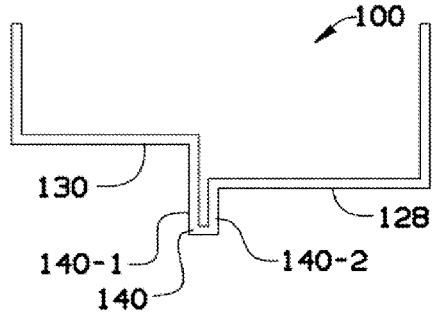
FIG. 4 is an end view of a reinforcing device in accordance with another embodiment of the present invention.
Figure 5:
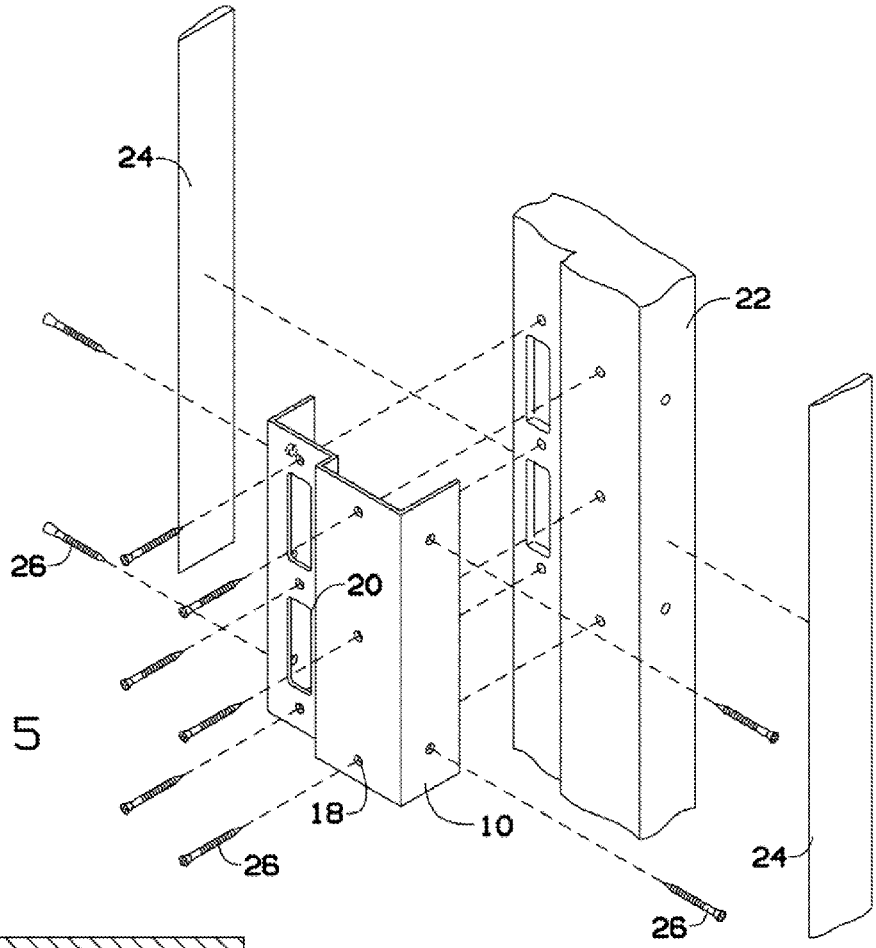
FIG. 5 is an exploded view of the reinforcing device of FIG. 1 and a door jamb in accordance with an embodiment of the invention.
Figure 6:
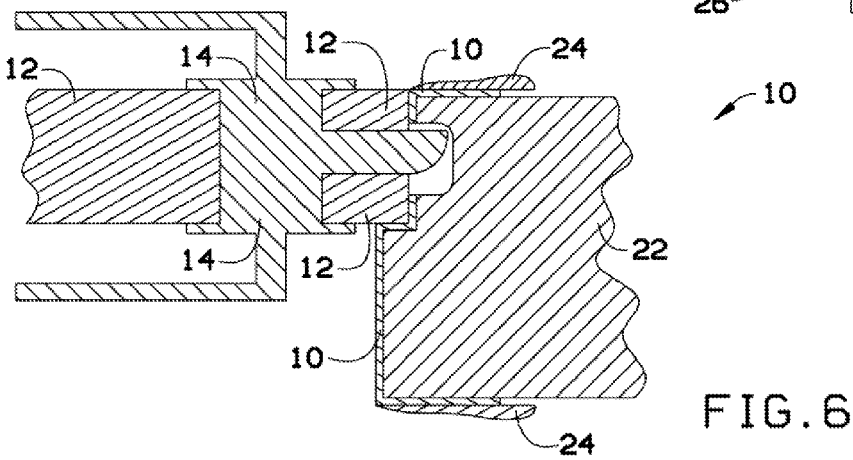
FIG. 6 is a cross sectional view of the reinforcing device of FIG. 1 taken along the lines 6-6 of FIG. 1.
Figure 7:
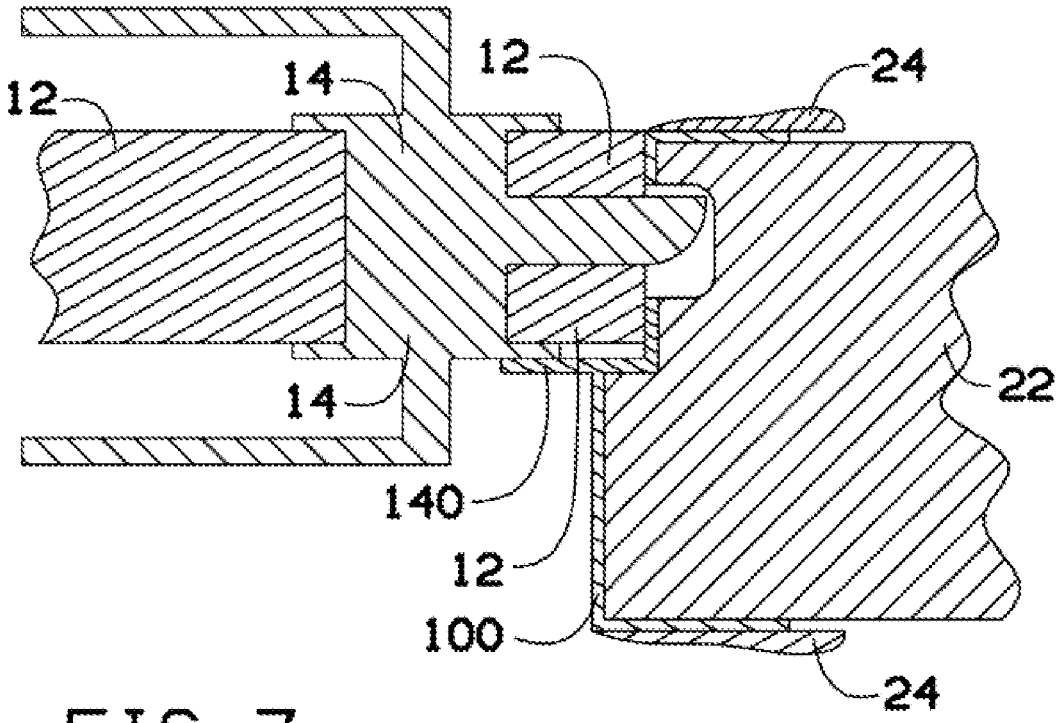
FIG. 7 is a cross-sectional view of the reinforcing device of FIG. 4 installed in a door jamb.

Referring now to FIGS. 4 and 7, it may be seen that a reinforcing device 100 may be constructed with a feature that may defeat attempted latch prying by a potential intruder.

The device 100 may be formed so that a face member 128 and a face member 130 may be joined with an anti-pry transition member 140. The anti-pry transition member 140 may comprise a folded metal structure that may include a first element 140-1 extending orthogonally from the face 130 and a second element 140-2 extending orthogonally from the face 128. The elements 140-1 and 140-2 may be formed as a continuous fold of metal that is integral with the faces 128 and 130.

Referring now to FIG. 7, it may be seen that, when installed, the anti-pry transition member 140 may overlie a portion of a closed door 12. In that regard, the anti-pry transition member 140 may form a metallic block that may preclude introduction of a prying device into the space between the door 12 and the jamb 22. Thus prying open of a door locking latch by a potential intruder may be prevented.

It should be understood, of course, that the foregoing relates to exemplary embodiments of the invention and that modifications may be made without departing from the spirit and scope of the invention as set forth in the following claims.

What is claimed is:

1. A door jamb reinforcing device comprising:

a first face member configured to engage with a face of a stop rail of the door jamb;

a second face member interconnected with the first face member and configured to engage with a face of a latch-engagement portion of the door jamb;

wherein the first face member is located in a first plane and the second face member is located in a second plane different from the first plane;

a first side member attached orthogonally to the first face member; a second side member attached orthogonally to the second face member, the first and second side members being spaced apart from one another by a distance that corresponds to a width of the door jamb;

wherein the first and second face members are interconnected with an anti-pry transition member;

wherein the anti-pry transition member comprises:

a first element extending orthogonally from the first face member; and a second element extending orthogonally from the second face member, wherein the first and second elements are formed as a continuous fold of sheet metal, and wherein the first element has a length different then the second element.

2. The device of claim 1 wherein the second face member is provided with one or more latch openings configured to align with one or more mortised openings in the jamb.

3. The device of claim 1 wherein the first and second face members and the first and second side members are provided with screw holes.

4. The device of claim 1 wherein the first and second face members, the first and second side members and the transition member are formed integrally from a single piece of sheet metal.

5. A method for using the door jamb reinforcing device of claim 1, comprising the steps of:

attaching a first metallic face member of an integral sheet metal reinforcing device to a face of a stop rail of the jamb;

attaching a second face member of the device to a face of a latching portion of the jamb;

attaching a first side member of the device to a side of the stop rail; and attaching a second side member of the device to a side of the latching portion of the jamb.

6. The method of claim 5 further comprising the steps of removing molding from the jamb prior to attaching the device to the jamb; and placing molding over the side members after attaching the device to the jamb.

7. The method of claim 5 further comprising the step of positioning an integral anti-pry transition member of the device so that it overlies a portion of a door that is closed within the jamb.

* * * * *